United States Patent [19]

Uchida et al.

[11] Patent Number: 4,964,144

[45] Date of Patent: Oct. 16, 1990

[54] COUNTER FOR ELECTRIC SWITCH DEVICE

[75] Inventors: Kazumi Uchida; Kotaro Tomioka, both of Kanagawa, Japan

[73] Assignee: Fuji Electric Co., Ltd., Kanagawa, Japan

[21] Appl. No.: 390,911

[22] Filed: Aug. 8, 1989

[30] Foreign Application Priority Data

Aug. 11, 1988 [JP] Japan ..... 63-106194[U]
Aug. 11, 1988 [JP] Japan ..... 63-106195[U]
Jun. 16, 1989 [JP] Japan ..... 1-70439[U]

[51] Int. Cl.[5] ..... G06M 3/02

[52] U.S. Cl. ..... 377/15; 377/82; 200/308

[58] Field of Search ..... 377/15, 82; 200/308, 200/338

[56] References Cited

U.S. PATENT DOCUMENTS 2,951,196 8/1960 Marohn ..... 377/15
3,580,498 5/1971 La Pointe et al. ..... 377/82
3,588,458 6/1971 Walter ..... 377/82
4,112,271 9/1978 Marchetti ..... 200/308
4,146,766 3/1979 Forrester et al. ..... 200/308
4,150,283 4/1979 Fleischer ..... 377/15
4,890,306 12/1989 Noda ..... 377/15

*Primary Examiner*—John S. Heymnan
*Attorney, Agent, or Firm*—Finnegan, Henderson, Farabow, Garrett, and Dunner

[57] ABSTRACT

An electric switch device comprises a contact spring a movable contact element; a movable contact element-supporting member having a protrusion thereof for supporting the movable contact element through the contact spring; a fixed contact element disposed in opposed relation to the movable contact element, the movable and fixed contact elements being moved toward and away from each other to effect closing and opening operations; and a casing for containing the movable and fixed contact elements therein, the casing being provided with a hole through which the protrusion of the movable contact element-supporting member is projected outwardly according the movement of the movable contact element-supporting member. The electric switch also includes a counter mounted on the casing for counting the frequency of projection of the protrusion of the movable contact element-supporting member through the hole.

4 Claims, 3 Drawing Sheets

COUNTER FOR ELECTRIC SWITCH DEVICE

BACKGROUND OF THE INVENTION

1. Field of the Invention

This invention relates to an electric switch device incorporating a device for monitoring the lifetime of the switch device during its operation and for notifying the time for its maintenance and inspection.

2. Prior Art

FIG. 1 shows an electromagnetic contactor which is a typical example of electric switch devices. A fixed contact 1 is mounted on one end of a fixed contact element 2, and a terminal screw 3 is connected to the other end of the fixed contact element 3. A movable contact 4 is mounted on a movable contact element 5 and is disposed in opposed relation to the fixed contact 1. The movable contact element 5 is supported on a movable contact element-supporting member 6 which is mounted on a movable core 7. The movable core 7 is adapted to be attracted by an electromagnet constituted by a fixed core 9 and a coil 10 and is adapted to be returned by a return spring 11, the fixed core 9 being mounted on the bottom of a casing 8 within which the movable core 7 is mounted. Reference numeral 12 denotes a contact spring, and reference numeral 13 denotes a distal end of the movable contact element-supporting member 6 projecting exteriorly of the casing 8 through a hole 14 formed through the casing 8. The distal end 13 is used for operation-indicating purposes, and also can be used to guess the lifetime of the electromagnetic contactor from the amount of projection of the distal end 13.

For opening and closing this electromagnetic contactor, a switch element (not shown) is closed to supply electric current to the coil 10 through an electric power source which is connected serially to the coil 10. As a result, the fixed core 9 is magnetized to attract the movable core 7, so that the movable contact element-supporting member 6 descends against the bias of the return spring 11. As a result, the movable contact 4 is brought into contact with the fixed contact 1 to thereby close the electromagnetic contactor. At this time, the contact spring 12 is compressed by the movable contact element-supporting member 6 to push the movable contact element 5 so as to urge the movable contact 4 against the fixed contact 1. When the electric current to the coil 10 is interrupted, the movable core 7 is moved upwardly under the bias of the return spring 11, so that the fixed contact 1 is spaced apart from the movable contact 4, thereby opening the electromagnetic contactor.

In an electric switch device such as an electromagnetic contactor, in order to know whether the consumption of the contacts reaches a limit when the contacts are fused, dissipated and consumed by the energy produced by its opening and closing operations, this has conventionally been done by periodically removable the contact elements and checking the appearance thereof, or by a method of measuring a so-called wipe amount in which the electric switch device can be still used even when the contacts are worn. However, the lifetime can not be accurately determined by checking the external appearance with the naked eyes. Therefore, there has been proposed another method in which as shown in FIG. 1, the distal end 13 of the movable contact element-supporting member 6 is adapted to project outwardly through the hole 14 formed through the casing 8, and the amount of consumption cf the two contacts 1 and 4 is guessed by viewing the amount of projection of the distal end 13 when the two contacts 1 and 4 are held in contact with each other.

There has been known that the lifetime of the contacts depends on the frequency of their opening and closing operations. However, if the inspection is periodically carried out, the frequency of the opening and closing operations during such a period is not always constant, and the time for such inspection can not be grasped quantitatively. Therefore, in another conventional method, a photoelectric switch is used for detecting the movement of the movable contact element 5. Each time the electromagnetic contactor is opened and closed, the light applied from a light-emitting portion of the photoelectric switch to its light-receiving portion is interrupted by a light shield plate mounted on the movable contact element-supporting member 6, and the frequency of such interruption is counted by the light-receiving portion, thereby determining the time for the inspection of the lifetime of the electromagnetic contactor. However, the former method has a problem that the visual inspection of the amount of projection of the distal end 13 is not precise. The latter method also suffers from the drawback that the use of the photoelectric switch makes the device complicated.

SUMMARY OF THE INVENTION

It is therefore a first object of this invention to provide an electric switch device in which the frequency of opening and closing operations is counted with a simple construction, and in accordance with this frequency the expiration of the lifetime can be guessed through experience, or the time for the inspection can be determined.

Another object of the invention is to provide an electric switch device in which when the frequency of the opening and closing operations reaches a predetermined value, a signal is outputted to the exterior.

The above first object of the invention has been achieved by an electric switch device comprising a movable contact element supported on a movable contact element-supporting member through a contact spring, and a fixed contact element disposed in opposed relation to said movable contact element, the two contact elements being moved toward and away from each other to thereby effect closing and opening operations; characterized in that a hole is formed in a casing containing the two contact elements, so that a distal end of the movable contact element-supporting member can be projected outwardly through the hole in accordance with the movement of the movable contact element-supporting member; and a counter for counting the frequency of projection of said distal end of the movable contact element-supporting member through the hole, said movable contact element-supporting member being mounted on the casing by hooks formed on the casing, and pawls formed on the counter and engaged with the hooks.

The above second object of the invention has been achieved by an electric switch device in which said counter contains a signal generator which produces a signal when the count of the counter reaches a predetermined value.

In an electric switch device such as an electromagnetic contactor, a movable contact element-supporting member which supports a movable contact element is driven by an electromagnet so that the movable contact is moved toward and away from a fixed contact. A hole is formed in a casing containing the parts of the electric switch device, and the distal end of the movable contact element-supporting member is adapted to be extended through this hole. This distal end, when moved, pushes a push button of a counter, mounted on the electric switch device, to cause the counter to effect its counting operation. Since the frequency of pushing of this push button of the counter is equal to the frequency of the opening and closing operations of the electric switch device, the latter frequency can be easily known. If the counter is designed to produce a signal when the frequency of the opening and closing operations of the electric switch device reaches a predetermined value, the expiration of the lifetime can be predicted.

DETAILED DESCRIPTION OF THE PREFERRED EMBODIMENTS

Figure 1:
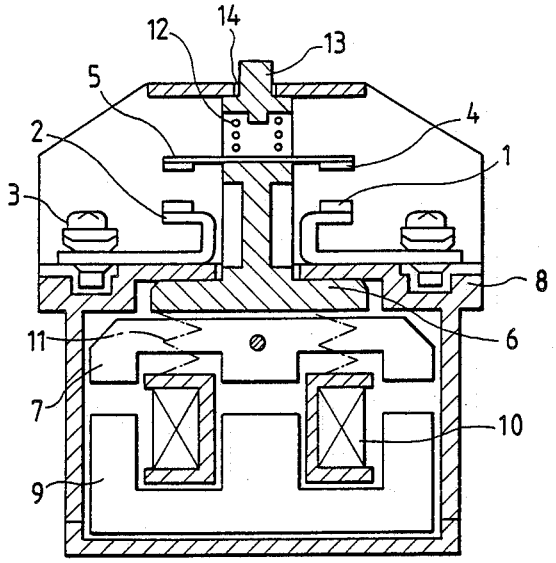
FIG. 1 PRIOR ART
FIG. 1 is a cross-sectional view of a conventional electromagnetic contactor.

One preferred embodiment of an electromagnetic contactor of the present invention is shown in FIGS. 2 to 5 wherein those parts identical to those of FIG. 1 are denoted by the same reference numerals, respectively.

Figure 2:
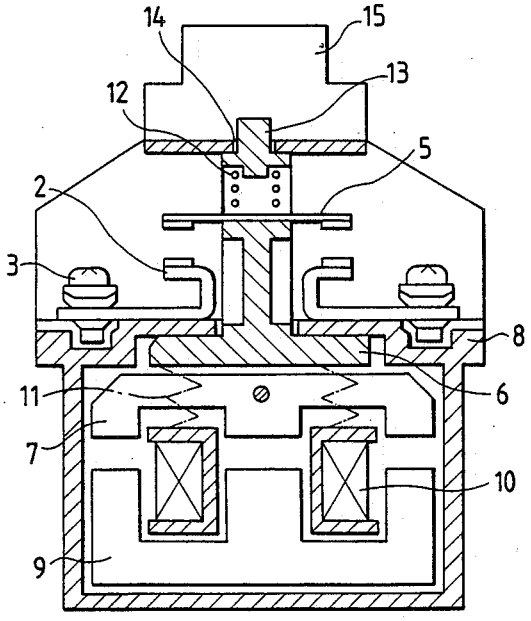
FIG. 2 is a cross-sectional view of the overall construction of the electromagnetic contactor according to the present invention.
Figure 3:
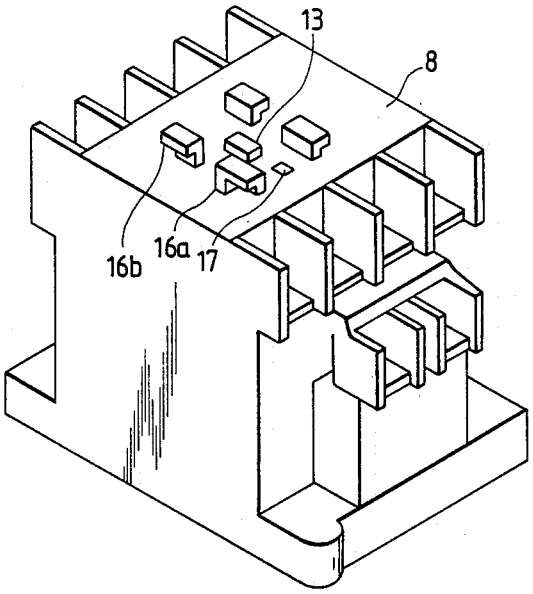
FIG. 3 is a perspective view showing the appearance of a casing.
Figure 4:
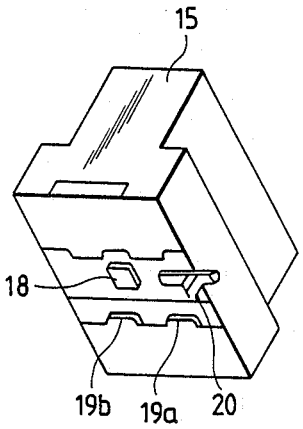
FIG. 4 is a perspective view showing the appearance of a counter according to one embodiment of the invention.

In FIG. 2, in the same manner as described above with reference to FIG. 1, a movable contact element-supporting member 6 of the electromagnetic contactor for supporting a movable contact element 5 is driven upward and downward when a movable core 7, on which the movable contact element-supporting member 6 is mounted, is attached by an electromagnet constituted by a fixed core 9 and a coil 10 and when the supporting member 6 is returned by a return spring 11. A distal end 13 of the movable contact element-supporting member 6 is adapted to be extended through a hole 14 formed through a casing 8 so as to be projected exteriorly. A counter 15 is mounted on the surface of the casing 8, from which the distal end 13 of the movable contact element-supporting member 6 is adapted to be projected exteriorly, in such a manner that the distal end 13 is adapted to press a counting push button of the counter 15. Referring to this construction more specifically, as shown in FIG. 3, hooks **16*a* and 16*b*, a positioning recess 17, etc., are provided at the surface of the casing 8 from which the distal end of the movable contact element-supporting member 6 is adapted to be projected exteriorly, the hooks 16*a* and 16*b* and the positioning recess 17 being disposed around the hole 14. As shown in FIG. 4, the counter 15 has pawls 19*a* and 19*b* engageable with the hooks 16*a* and 16*b*, and a projection 20 engageable in the recess 17, the pawls 19*a* and 19*b* and the projection 20 being disposed around the counting pushbutton 18. The counter 15 has digit wheels arranged in juxtaposed relation to one another. Each time the counting pushbutton 18** is pushed, the digit wheel at the smallest unit's place makes one tenth of one rotation, and when the digit wheel at the smallest unit's place makes one rotation, the digit wheel at the next unit's place makes one tenth of one rotation. The counter of this digit wheel-type is well known.

Figure 5:
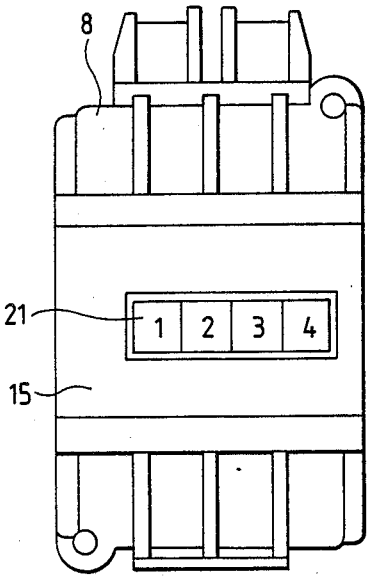
FIG. 5 is a plan view of the counter.

The counter 15 can be easily mounted in position on the electromagnetic contactor by fitting the projection 20 of the counter in the recess 17 of the electromagnetic contactor and by engaging the pawls **19*a* and 19*b* with the hooks 16*a* and 16*b*, respectively. As shown in FIG. 5, a count display portion 21 is provided on the upper side of the counter 15, and therefore even when the electromagnetic contactor is mounted on a side wall of a switchboard, the count display portion 21** can be easily viewed from the side.

Another embodiment of the invention will now be described with reference to FIGS. 6 and 7. This embodiment differs from the embodiment of FIGS. 2 to 5 only in that a different type of counter is used, and therefore only the counter is shown.

Figure 6:
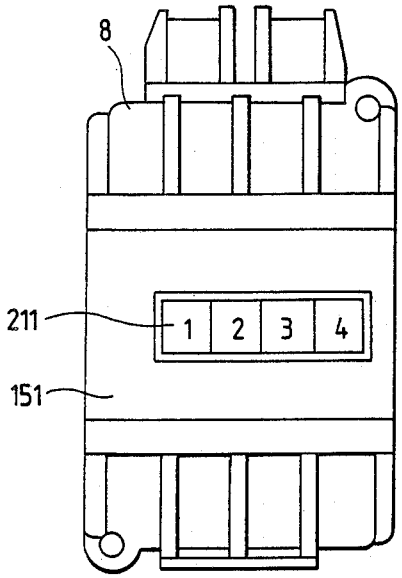
FIG. 6 is a plan view of a counter according to another embodiment of the invention.
Figure 7:
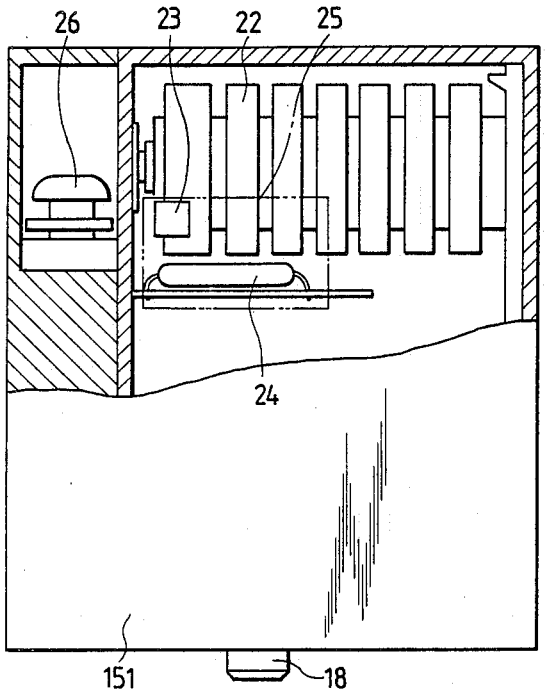
FIG. 7 is a partially cross-sectional view of the counter of FIG. 6.

In FIG. 6, reference numeral 151 denotes the counter having a count display portion 211 provided at a casing 81. As shown in FIG. 7, this counter 151 includes a signal generator 25 which comprises a permanent magnet 23 mounted on a digit wheel 22, and a reed switch 24 mounted in the vicinity of this digit wheel 22. When the permanent magnet 23 approaches the reed switch 24, the reed switch 24 is closed, so that the signal generator 25 produces a signal. The digit wheels 22 are of the decimal system, and each time the digit wheel makes one rotation, the digit wheel at the next larger unit's place increments by one. The permanent magnet 23 can be mounted at the position corresponding to any desired number or digit on the digit wheel at any desired one of the unit's places, and this position can be changed. Reference numeral 26 denotes a terminal connected to a contact of the signal generating portion 25, and a power source, a bell or the like is connected to this terminal.

In the present invention, the counter for counting the frequency of the opening and closing operations of the electric switch device can be easily mounted on the electric switch device, and the frequency of the opening and closing operations of the electric switch device can be recognized by this counter. Therefore, a loss, which would caused by an accidental stop of the operation of the system due to imperfect contact caused by the exhausted contacts, can be prevented. Also, the time for the maintenance and inspection of the electric switch device, which have conventionally been carried out by periodically stopping the operation of the electric switch device, can be determined by the frequency of the opening and closing operations of the electric switch device, and therefore advantageously the time and labor can be reduced.

Further, in the present invention, the expiration of the lifetime of the electric switch device can be predicted by incorporating, into the counter for counting the frequency of the opening and closing operations of the electric switch device, the signal generating portion which produces a signal when the count of the counter reaches the predetermined value.

What is claimed is:

1. An electric switch device, comprising:

a contact spring a movable contact element;

a movable contact element-supporting member having a protrusion thereof for supporting said movable contact element through said contact spring;

a fixed contact element disposed in opposed relation to said movable contact element, said movable and fixed contact elements being moved toward and away from each other to effect closing and opening operations;

a casing for containing said movable and fixed contact elements therein, said casing being provided with a hole through which said protrusion of said movable contact element-supporting member is projected outwardly according the movement of said movable contact element-supporting member, and a counter mounted on said casing for counting the frequency of projection of said protrusion of said movable contact element-supporting member through said hole.

2. An electric switch device as claimed in claim 1, wherein said casing is provided with hooks, and said counter is provided with pawls so that said counter is engaged with said casing by said hooks and pawls.

3. An electric switch device as claimed in claim 1, wherein said counter is provided with a signal generator for outputting a signal when the counting number of said counter reaches a predetermined value.

4. An electric switch device as claimed in claim 1, wherein said counter is provided with a count display member.

* * * * *